US007077540B2

(12) United States Patent
Yen

(10) Patent No.: US 7,077,540 B2
(45) Date of Patent: Jul. 18, 2006

(54) EMERGENCY LIGHT SET

(76) Inventor: Jen-Yen Yen, No. 22-1, Lane 3, Haochin Rd., Nanhsin Tsun, Yenpu Hsiang, Changhua County (TW)

( * ) Notice: Subject to any disclaimer, the term of this patent is extended or adjusted under 35 U.S.C. 154(b) by 73 days.

(21) Appl. No.: 10/983,632

(22) Filed: Nov. 9, 2004

(65) Prior Publication Data

US 2006/0098426 A1 May 11, 2006

(51) Int. Cl.
*F21L 4/00* (2006.01)

(52) U.S. Cl. ..... 362/183; 362/192; 362/119; 7/165; 7/167

(58) Field of Classification Search ..... 362/183, 362/109, 192, 120, 119; 7/165, 167, 128, 7/168; 320/114, 115; 81/177.6
See application file for complete search history.

(56) References Cited

U.S. PATENT DOCUMENTS

| | | | | |
|---|---|---|---|---|
| 6,182,541 | B1 * | 2/2001 | Anderson et al. | 81/440 |
| 6,314,600 | B1 * | 11/2001 | Cachot | 7/128 |
| 6,959,999 | B1 * | 11/2005 | Lee | 362/192 |
| 2005/0052861 | A1 * | 3/2005 | Leu | 362/119 |

* cited by examiner

*Primary Examiner*—Renee Luebke
*Assistant Examiner*—Zahra I. Bennett
(74) *Attorney, Agent, or Firm*—Rosenberg, Klein & Lee

(57) ABSTRACT

An emergency light set is disclosed to include a bottom cover shell covered with a top cover shell, a lamp mounted in the front side of the bottom cover shell, a mini power generator mounted in the bottom cover shell and electrically connected to the lamp, a rechargeable battery for providing electricity to the lamp, a transmission gear set, and a tool handle detachably mounted in the top cover shell and connectable to the input shaft of the transmission gear set for operation by the user to rotate the transmission gear set and to further drive the mini power generator to generate electricity.

2 Claims, 5 Drawing Sheets

EMERGENCY LIGHT SET

BACKGROUND OF THE INVENTION

1. Field of the Invention

The present invention relates to light set and more particularly, to an emergency light set.

2. Description of the Related Art

Conventional rod-like hand tools (such as screwdriver, socket wrench, and etc.) may be equipped with an illuminator. These hand tools simply work as a specific tool. Further, regular hand tools with illuminator are commonly bulky and heavy, not convenient to work. These hand tools use a battery to provide the necessary working voltage to the illuminator. The user must frequently replace the battery before battery low. Therefore, conventional hand tools with illuminator are not suitable for use as an emergency light set.

SUMMARY OF THE INVENTION

The present invention has been accomplished under the circumstances in view. It is the main object of the present invention to provide an emergency light set, which uses a rechargeable battery to provide the necessary working voltage to the lamp. It is another object of the present invention to provide an emergency light set, which uses a hand-operated power generator to generate electricity for the lamp when battery failed, and a transmission gear set for driving the hand-operated power generator to generate electricity. According to still another object of the present invention to provide an emergency light set, which is equipped with a detachable hand tool that can be used for turning the transmission gear set to drive the hand-operated power generator to generate electricity with less effort.

To achieve these and other objects of the present invention, the emergency light set comprises a bottom cover shell; a top cover shell covered on the bottom cover shell, the top cover shell having a top open chamber and a plughole in a front side of the top open chamber; a lamp mounted in a front side of the bottom cover shell; a mini power generator mounted inside the bottom cover shell and electrically connected to the lamp and adapted to generate electricity for the lamp; a transmission gear set mounted inside the bottom cover shell and adapted to drive the mini power generator to generate electricity, the transmission gear set having an input shaft suspending in the plughole of the top cover shell; and a rechargeable battery mounted inside the bottom cover shell and electrically connected to the lamp; wherein a tool handle is detachably mounted in the top open chamber of the top cover shell and connectable to the input shaft of the transmission gear set for operation by the user to rotate the input shaft and to further drive the mini power generator to generate electricity, the tool handle comprising an adapter for holding a tool tip, the adapter being insertable into the plughole of the top cove shell and connectable to the input shaft of the transmission gear set.

BRIEF DESCRIPTION OF THE DRAWINGS

FIG. 2 is a schematic perspective view of the present invention, showing the lamp of the emergency light set turned on.

DETAILED DESCRIPTION OF THE PREFERRED EMBODIMENT

Figure 1:
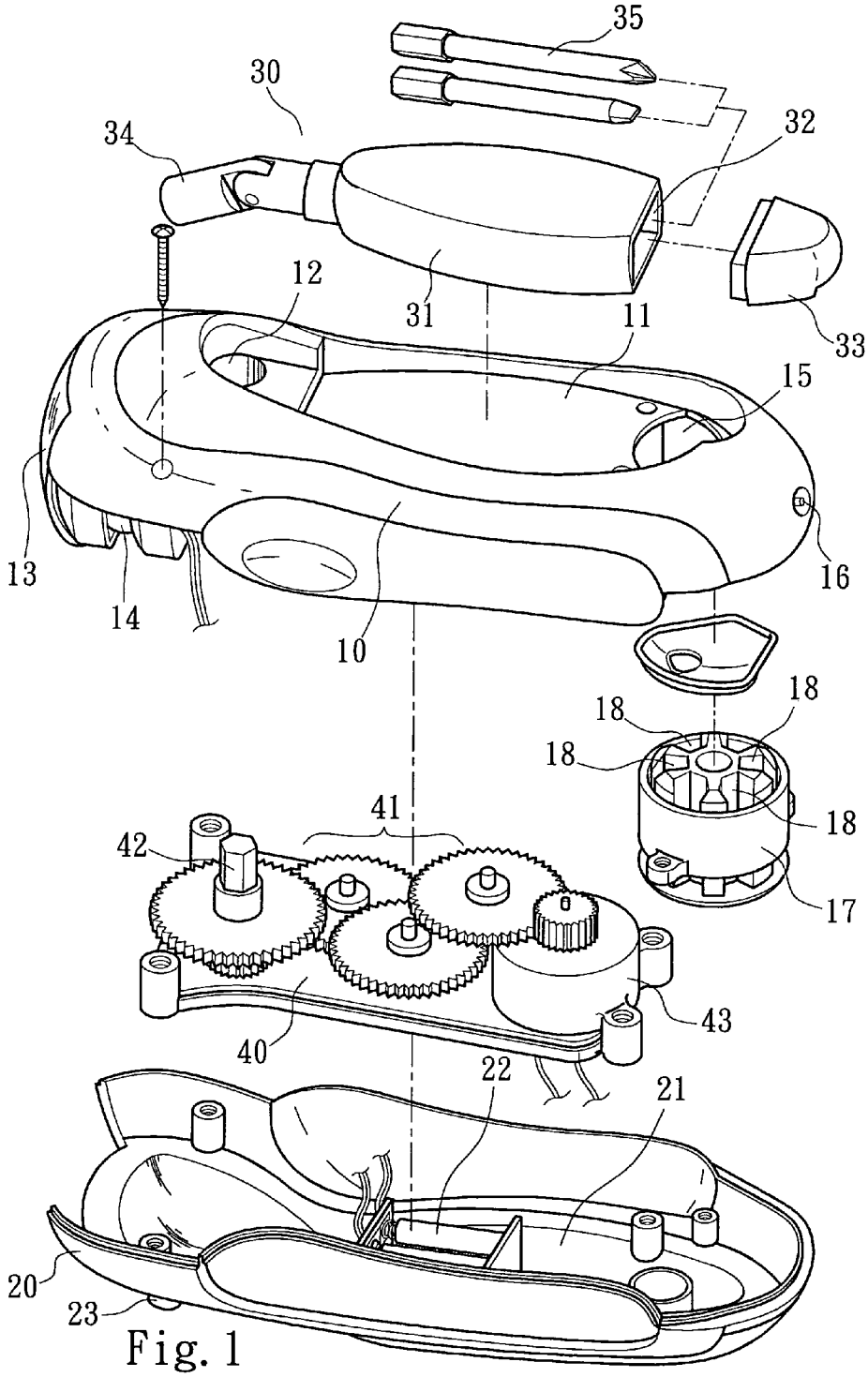
FIG. 1 is an exploded view of an emergency light set according to the present invention.

Referring to FIGS. 1–5, an emergency light set in accordance with the present invention is shown comprised of a top cover shell 10, a bottom cover shell 20, a transmission gear set 41, a mini power generator 43, and a tool handle 30.

The top cover shell 10 comprises a front lampshade 13, a lamp 14 provided behind the front lampshade 13, a top open chamber 11, a vertical plughole 12 disposed in the top open chamber 11 near the front side, and a battery-charging power jack 16 provided at the rear side.

The bottom cover shell 20 comprises a receiving chamber 21, a rechargeable battery 22 mounted in the receiving chamber 21 and electrically between the lamp 14 and the battery-charging power jack 16, and an on/off switch 23 disposed on the outside and electrically connected in series between the lamp 14 and the rechargeable battery 22.

The transmission gear set 41 and the mini power generator 43 are fixedly mounted on a mounting plate 40, which is then installed in the receiving chamber 21 of the bottom cover shell 20 above the rechargeable battery 22. After installation of the transmission gear set 41 and the mini power generator 43 with the mounting plate 40 in the bottom cover shell 20, the top cover shell 10 is closed on the bottom cover shell 20. The transmission gear set 41 is coupled to the shaft of the mini power generator 43, having an input shaft 42 suspended in the plughole 12 of the top cover shell 10 for rotation by the user to drive the mini power generator 43, thereby causing the mini power generator 43 to generate electricity and to provide generated electricity to the lamp 14.

The tool handle 30 comprises a hollow tool handle body 31, which defines a receiving chamber 32 for keeping a set of tool bits 35, an adapter 34 pivoted to the front side of the tool handle body 31 for holding and turning one of the set of tool bits 35, and a cap 33, which closes the receiving chamber 32. The adapter 34 is inserted into the plughole 12 in the top cover shell 10 and coupled to the input shaft 42 of the transmission gear set 41, and the tool handle body 31 is set in the top open chamber 11 of the top cover shell 10. The user can turn the tool handle body 31 out of the top open chamber 11 and driven by hand to rotate the input shaft 42 of the transmission gear set 41 and to further drive the mini power generator 43 to generate electricity. The user can also remove the tool handle 30 from the top cover shell 10 and attach one tool bit 35 to the adapter 34 to form a hand tool for a particular work.

Figure 2:
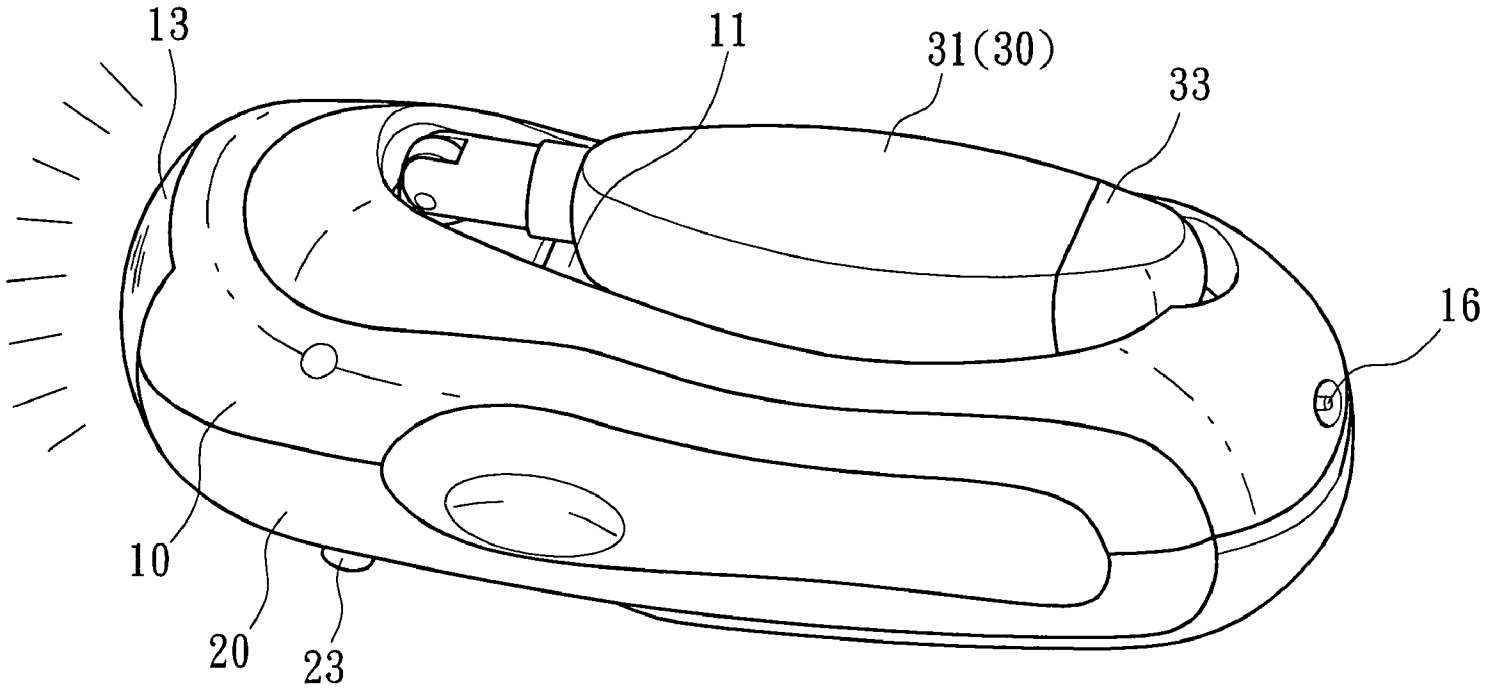

Referring to FIG. 2 and FIG. 1 again, when the tool handle 30 is received in the top open chamber 11 of the top cover shell 10, the adapter 34 is maintained inserted into the plughole 12 in the top cover shell 10 and coupled to the input shaft 42 of the transmission gear set 41, therefore, the tool handle 30 is kept firmly in the top cover shell 10. When the user switched on the on/off switch 23, the lamp 14 is turned on to give off light. Further, the user can connect city power supply to the battery-charging power jack 16 to charge the rechargeable battery 22.

Figure 3:
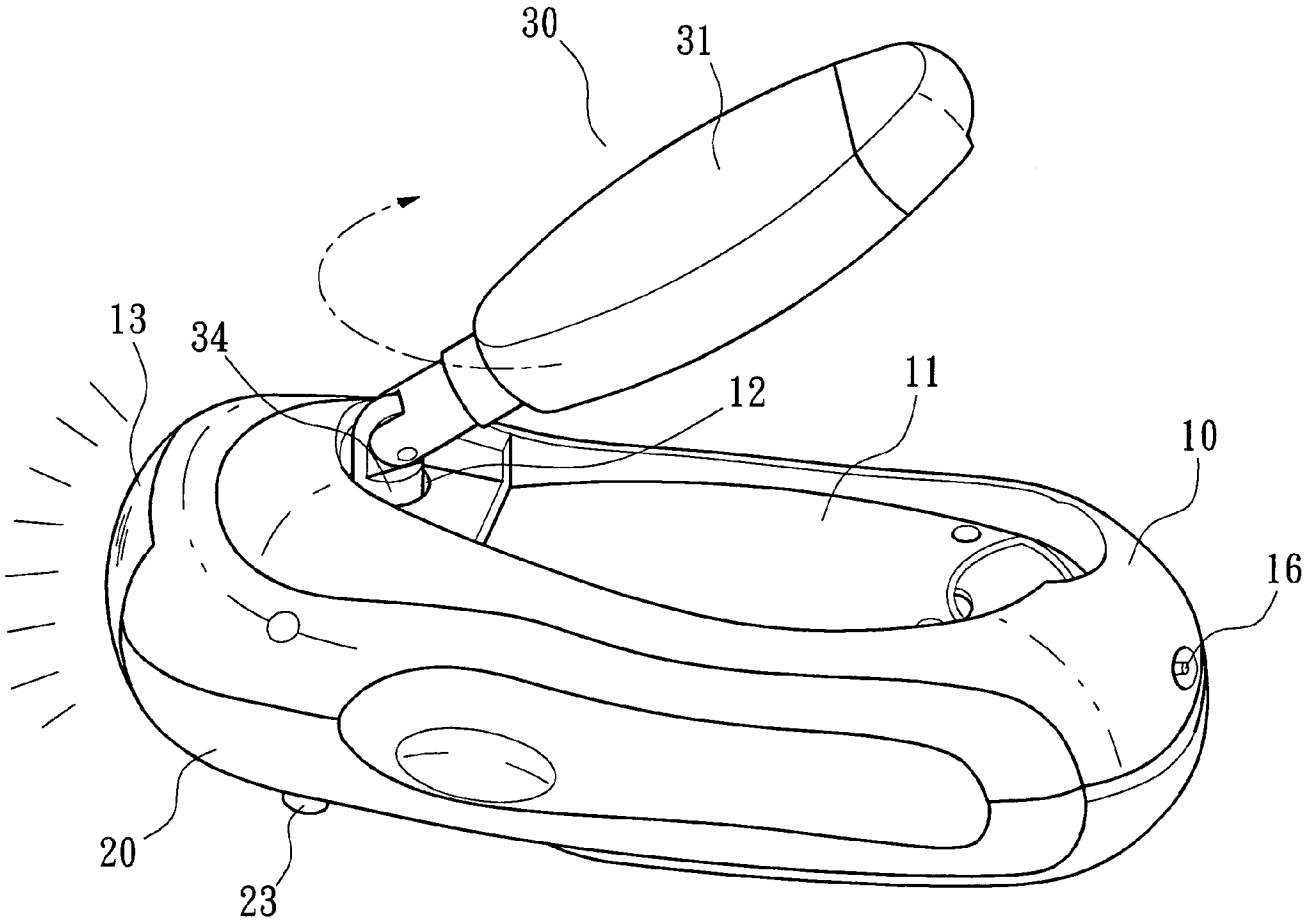
FIG. 3 is a schematic drawing of the present invention, showing an operation status of the emergency light set.
Figure 4:
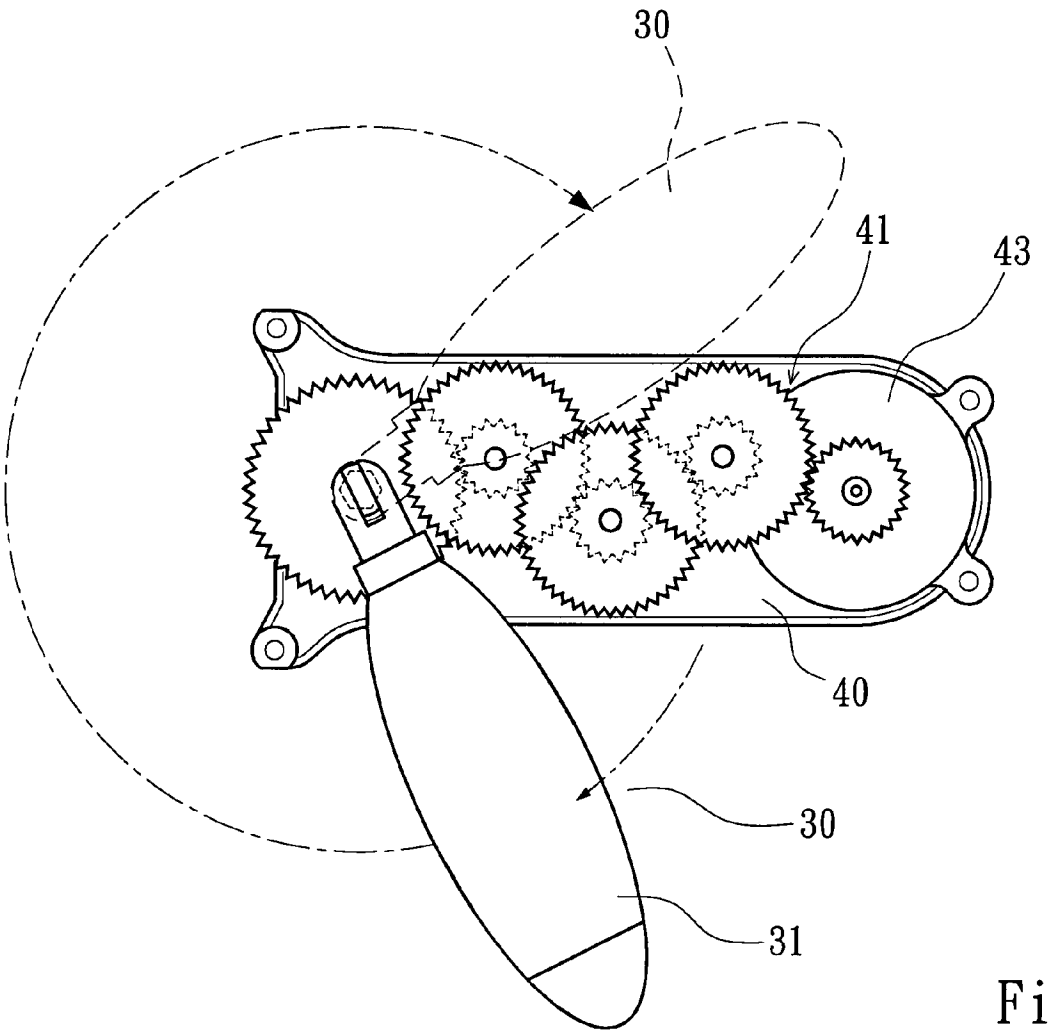
FIG. 4 is a schematic top view showing the operation of the tool handle and the transmission of rotary driving force from the tool handle to the mini power generator by the transmission gear set.

Referring to FIGS. 3 and 4 and FIG. 1 again, when the rechargeable battery 22 fails due to power low or is damaged, the user can lift the tool handle body 31 and drive the tool handle body 31 with the hand to rotate the input shaft 42 of the transmission gear set 41 and to further drive the mini power generator 43 to generate electricity, providing the necessary working voltage to the lamp 14.

Figure 5:
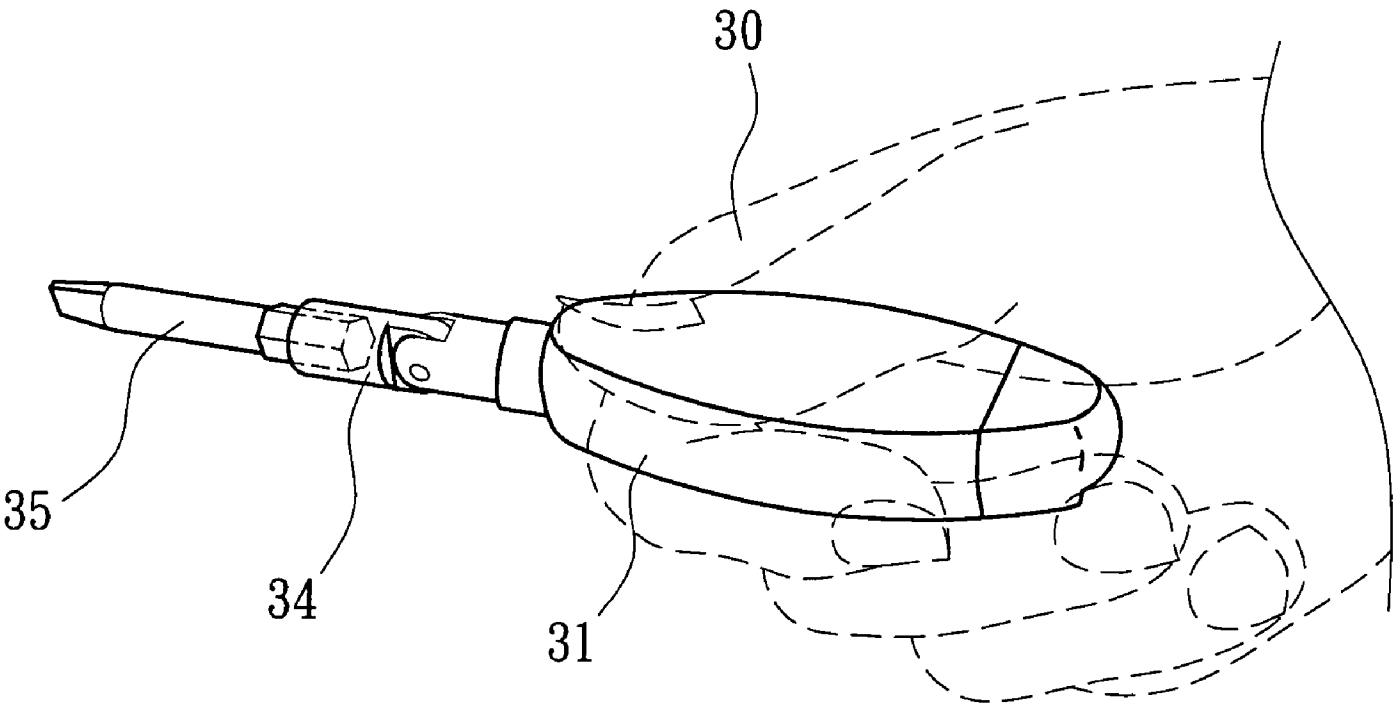
FIG. 5 is a schematic drawing showing the tool handle assembled with a tool bit into a hand tool.

Referring to FIG. 5, the user can also remove the tool handle 30 from the top cover shell 10 and attach one tool bit 35 to the adapter 34 to form a hand tool for a particular work.

Referring to FIG. 1 again, the top cover shell 10 further comprises a tool chamber 15 holding a tool rack 17, which comprises a plurality of compartments 18 for keeping small tool elements.

A prototype of emergency light set has been constructed with the features of FIGS. 1–5. The emergency light set functions smoothly to provide all the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An emergency light set comprising:

a bottom cover shell;

a top cover shell covered on said bottom cover shell, said top cover shell having a top open chamber and a plughole in a front side of said top open chamber;

a lamp mounted in a front side of said bottom cover shell;

a mini power generator mounted inside said bottom cover shell and electrically connected to said lamp and adapted to generate electricity for said lamp;

a transmission gear set mounted inside said bottom cover shell and adapted to drive said mini power generator to generate electricity, said transmission gear set having an input shaft suspending in said plughole of said top cover shell; and a rechargeable battery mounted inside said bottom cover shell and electrically connected to said lamp;

wherein a tool handle is detachably mounted in said top open chamber of said top cover shell and connectable to the input shaft of said transmission gear set for operation by the user to rotate said input shaft and to further drive said mini power generator to generate electricity, said tool handle comprising an adapter for holding a tool tip, said adapter being insertable into said plughole of said top cove shell and connectable to the input shaft of said transmission gear set.

2. The emergency light set as claimed in claim 1, wherein said bottom cover shell comprises a tool chamber, and a tool rack mounted inside said tool chamber, said tool rack having a plurality of compartments for keeping tool elements.

* * * * *